US005421544A

United States Patent [19]

Roop

[11] Patent Number: 5,421,544

[45] Date of Patent: Jun. 6, 1995

[54] VARIABLE WEIGHT MOLD

[76] Inventor: Donald D. Roop, 1612 E. M-28, Marquette, Mich. 49855

[21] Appl. No.: 304,885

[22] Filed: Sep. 13, 1994

[51] Int. Cl.[6] ..... B22C 9/06

[52] U.S. Cl. ..... 249/156; 249/163; 249/167

[58] Field of Search ..... 164/342, 137; 249/102, 249/156, 163, 165, 167; 425/595, 451.9

[56] References Cited

U.S. PATENT DOCUMENTS

| | | | |
|---|---|---|---|
| 845,668 | 2/1907 | Sweet, Jr. | 249/156 X |
| 1,030,198 | 6/1912 | McKee et al. | 164/342 X |
| 3,199,829 | 8/1965 | Calim | 249/102 X |
| 4,763,503 | 8/1988 | Hughes et al. | 164/342 X |
| 5,255,889 | 10/1993 | Collette et al. | 249/102 |

*Primary Examiner*—J. Reed Batten, Jr.

[57] ABSTRACT

The mold includes a first end molding component having an imperforate exterior face and an interior face with alignment pins and a recess for the receipt of fluid material to be molded; a second end molding component having an exterior face with a horizontal bore and an interior face with alignment holes and a recess for the receipt of fluid material to be molded, the second end component being provided with lateral clamping members, the second component being formed of a pair of laterally disposed subcomponents; a plurality of intermediate molding components, each with alignment pins on one face and alignment holes in the opposite face and with a recess therethrough adapted to be positioned between the end components, the number of intermediate components being a function of the desired size of the molded end products; and a pair of filler molding components both with alignment pins on one face and alignment holes in the opposite face and with a recess therethrough adapted to be positioned between the end components, the filler components including a vertical bore and well thereabove.

5 Claims, 5 Drawing Sheets

VARIABLE WEIGHT MOLD

BACKGROUND OF THE INVENTION

1. Field of the Invention

The present invention relates to a variable weight mold and more particularly pertains to stacking mold components together to form units of various sizes to produce cases of various sizing and weights for various purposes.

2. Description of the Prior Art

The use of casting products in molds of various designs, configurations, sizes and alike is known in the prior art. More specifically, casting products in molds of various designs, configurations, sizes and the like heretofore devised and utilized for the purpose of molding products of various sizes to a wide variety of techniques and apparatuses are known to consist basically of familiar, expected, and obvious structural configurations, notwithstanding the myriad of designs encompassed by the crowded prior art which has been developed for the fulfillment of countless objectives and requirements.

By way of example, the prior art discloses in U.S. Pat. No. 4,361,976 to Svoma a fishing line sinker and mold for making same.

U.S. Pat. No. 4,332,537 to Slepcevic discloses an encapsulation mold with removable cavity plates.

U.S. Pat. No. 4,278,231 to McGahee discloses a mold for fabricating fishing lures, etc.

U.S. Pat. No. 4,141,170 to Fosher discloses an artificial fishing lure and process for molding same.

U.S. Pat. No. 3,709,458 to Mattson discloses a mold for casting a weighted treble fishing hook.

In this respect, the variable weight mold according to the present invention substantially departs from the conventional concepts and designs of the prior art, and in doing so provides an apparatus primarily developed for the purpose of stacking mold components together to form units of various sizes to produce cases of various sizing and weights for various purposes.

Therefore, it can be appreciated that there exists a continuing need for a new and improved variable weight mold which can be used for stacking mold components together to form units of various sizes to produce cases of various sizing and weights for various purposes. In this regard, the present invention substantially fulfills this need.

SUMMARY OF THE INVENTION

In view of the foregoing disadvantages inherent in the known types of casting products in molds of various designs, configurations, sizes and alike now present in the prior art, the present invention provides an improved variable weight mold. As such, the general purpose of the present invention, which will be described subsequently in greater detail, is to provide a new and improved variable weight mold and method which has all the advantages of the prior art and none of the disadvantages.

To attain this, the present invention essentially comprises a new and improved variable weight mold comprising, in combination, a first end molding component having an imperforate exterior face and an interior face with alignment pins and a recess for the receipt of fluid material to be molded, the exterior face having a plurality of lateral clamping members with apertures; a second end molding component having an exterior face with a horizontal bore and an interior face with alignment holes and a recess for the receipt of fluid material to be molded, the second end component being provided with lateral clamping members, the second component being formed of a pair of laterally disposed subcomponents with vertical clamping members secured to each subcomponent; a plurality of intermediate molding components, each with alignment pins on one face and alignment holes in the opposite face and with a recess therethrough adapted to be positioned between the end components, the number of intermediate components being a function of the desired size of the molded end products; a pair of filler molding components both with alignment pins on one face and alignment holes in the opposite face and with a recess therethrough adapted to be positioned between the end components, the filler components including a vertical bore and well thereabove; coupling elements for coupling together the clamping members of the two subcomponents of the second end component; and additional coupling elements for coupling together the clamping members of the first end component with the second end component.

There has thus been outlined, rather broadly, the more important features of the invention in order that the detailed description thereof that follows may be better understood and in order that the present contribution to the art may be better appreciated. There are, of course, additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of descriptions and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent of legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved variable weight mold which has all the advantages of the prior art casting products in molds of various designs, configurations, sizes and alike and none of the disadvantages.

It is another object of the present invention to provide a new and improved variable weight mold which may be easily and efficiently manufactured and marketed.

It is further object of the present invention to provide a new and improved variable weight mold which is of durable and reliable constructions.

An even further object of the present invention is to provide a new and improved variable weight mold which is susceptible of a low cost of manufacture with regard to both materials and labor, and which accordingly is then susceptible of low prices of sale to the consuming public, thereby making such variable weight mold economically available to the buying public.

Still yet another object of the present invention is to provide a new and improved variable weight mold which provides in the apparatuses and methods of the prior art some of the advantages thereof, while simultaneously overcoming some of the disadvantages normally associated therewith.

Still another object of the present invention is to stack mold components together to form units of various sizes to produce cases of various sizing and weights for various purposes.

Lastly, it is an object of the present invention to provide a new and improved variable weight mold comprising a first end molding component having an imperforate exterior face and an interior face with alignment pins and a recess for the receipt of fluid material to be molded; a second end molding component having an exterior face with a horizontal bore and an interior face with alignment holes and a recess for the receipt of fluid material to be molded, the second end component being provided with lateral clamping members, the second component being formed of a pair of laterally disposed subcomponents; a plurality of intermediate molding components, each with alignment pins on one face and alignment holes in the opposite face and with a recess therethrough adapted to be positioned between the end components, the number of intermediate components being a function of the desired size of the molded end products; and a pair of filler molding components both with alignment pins on one face and alignment holes in the opposite face and with a recess therethrough adapted to be positioned between the end components, the filler components including a vertical bore and well thereabove.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

The same reference numerals refer to the same parts through the various figures.

DESCRIPTION OF THE PREFERRED EMBODIMENT

Figure 1:
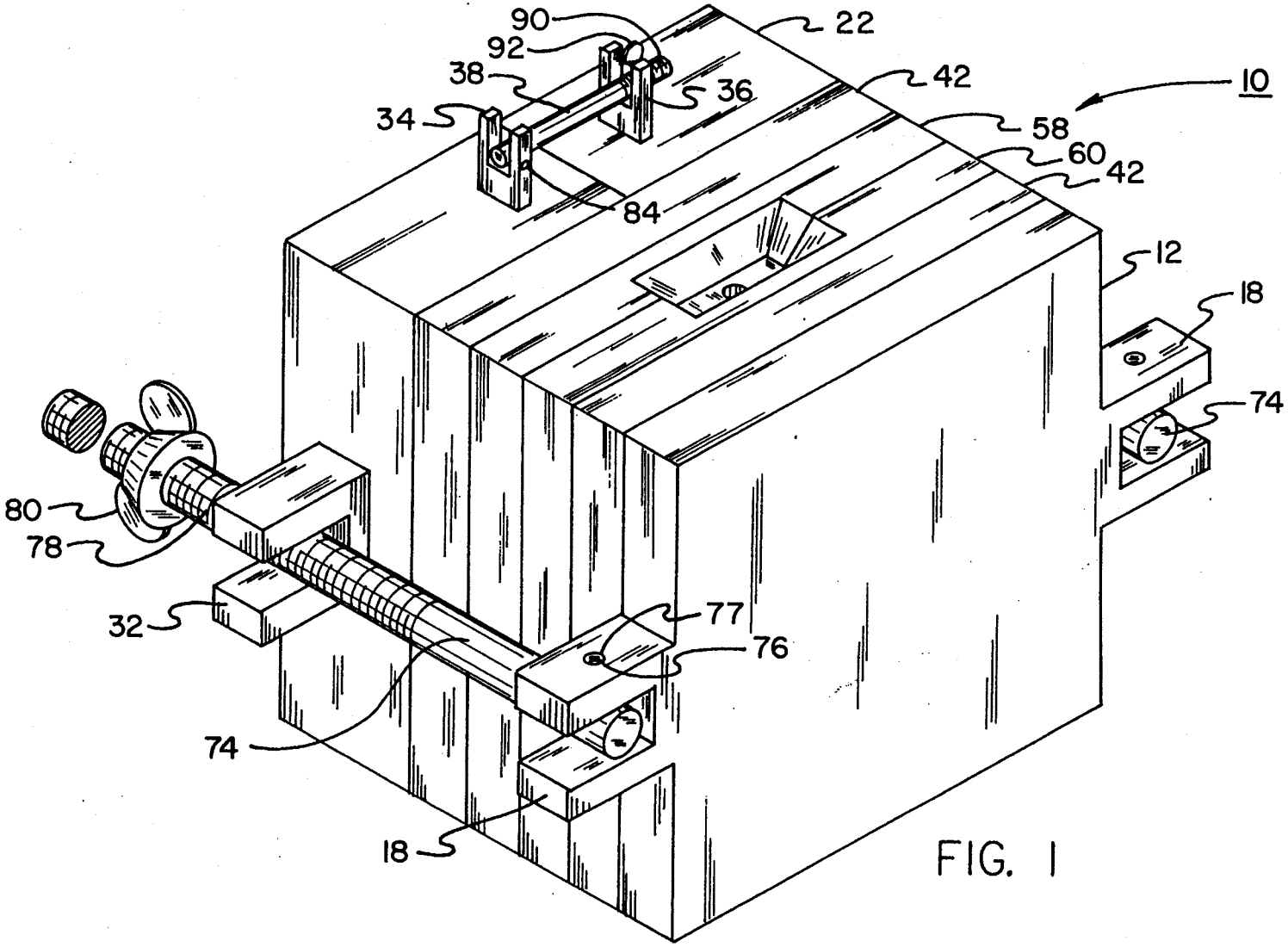
FIG. 1 is a perspective view of the preferred embodiment of the variable weight mold constructed in accordance with the principles of the present invention.
Figure 2:
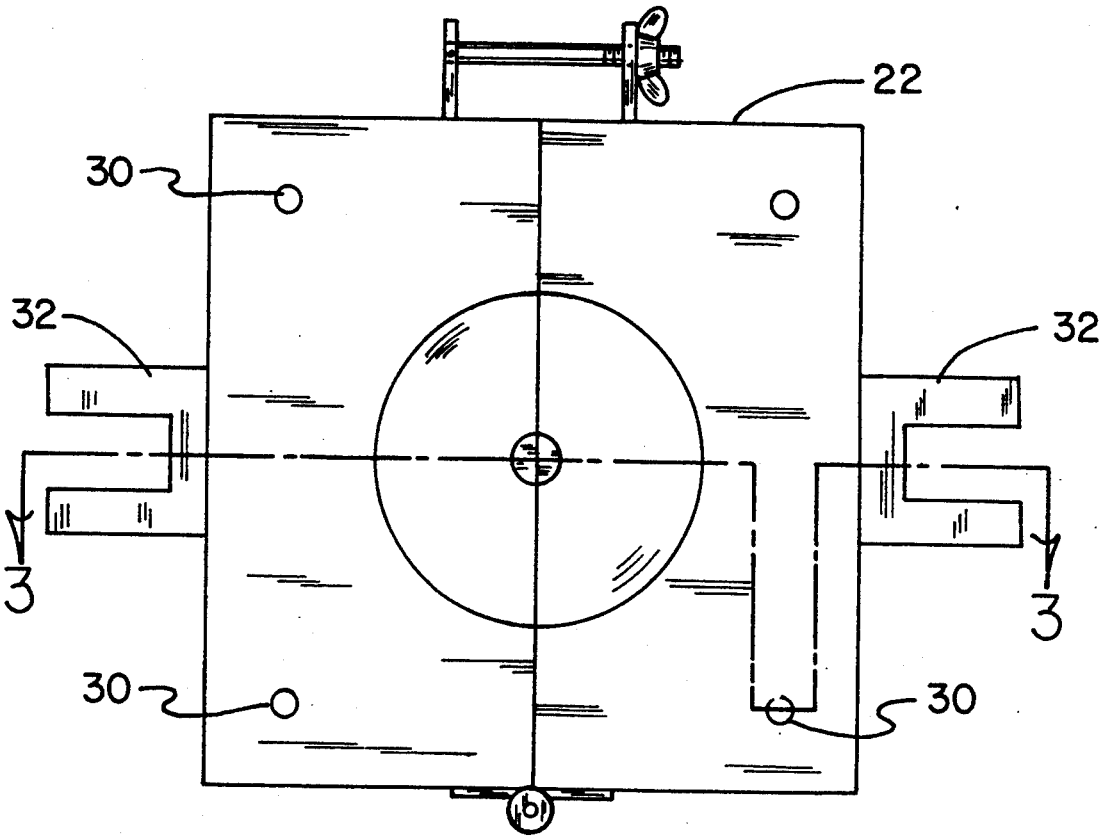
FIG. 2 is a top elevational view of a mold constructed in accordance with an alternate embodiment of the invention.
Figure 3:
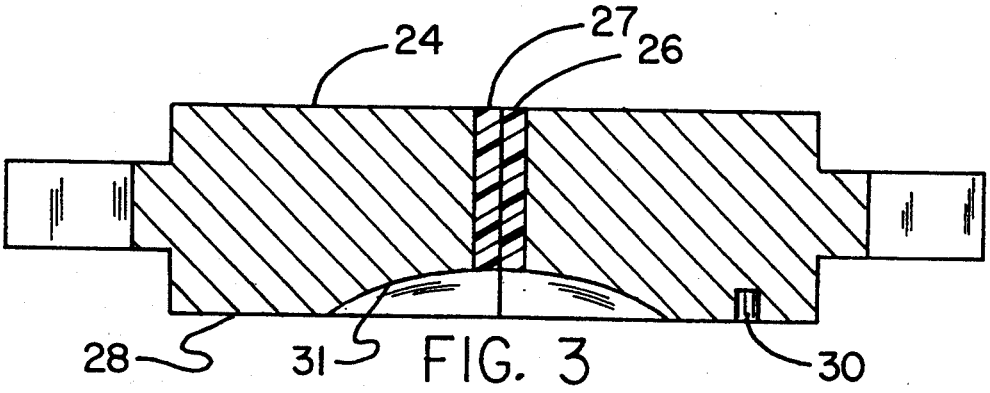
FIG. 3 is a cross-sectional view taken along line 3—3 of FIG. 2.
Figure 4:
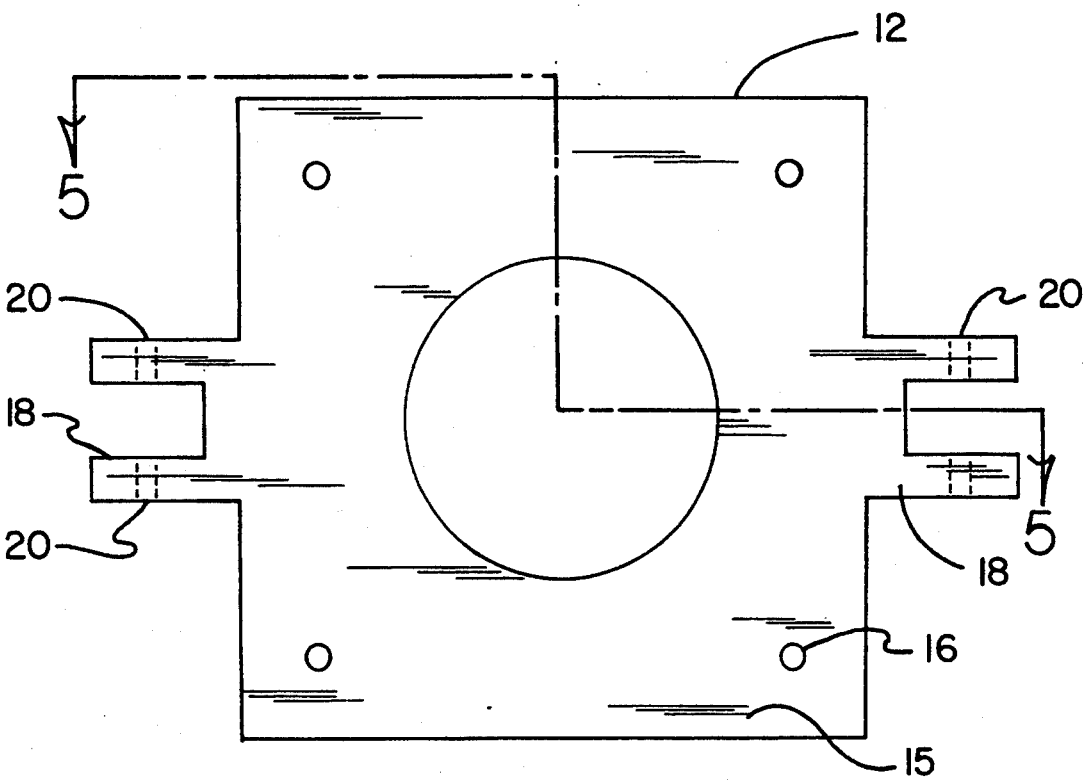
FIG. 4 is a bottom elevational view of the component shown in FIG. 3.
Figure 5:
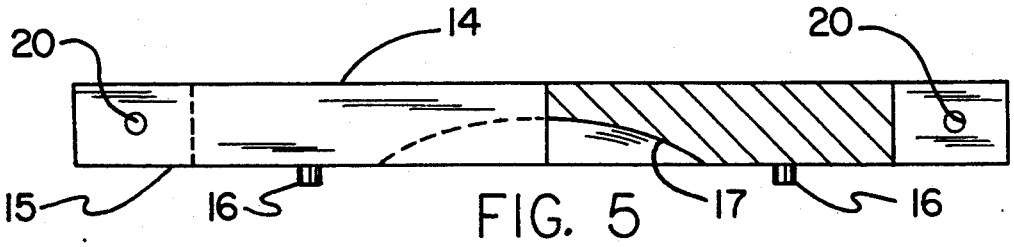
FIG. 5 is a cross-sectional view taken along line 5—5 of FIG. 4.
Figure 6:
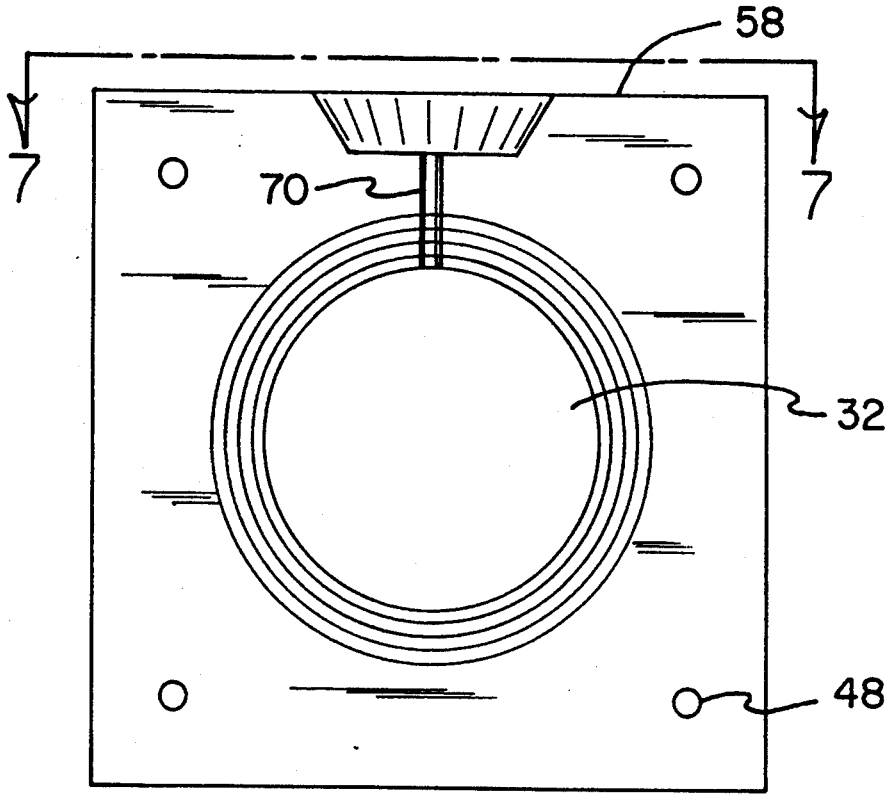
FIG. 6 is a front elevational view of one of the mold halves of FIG. 2.
Figure 7:
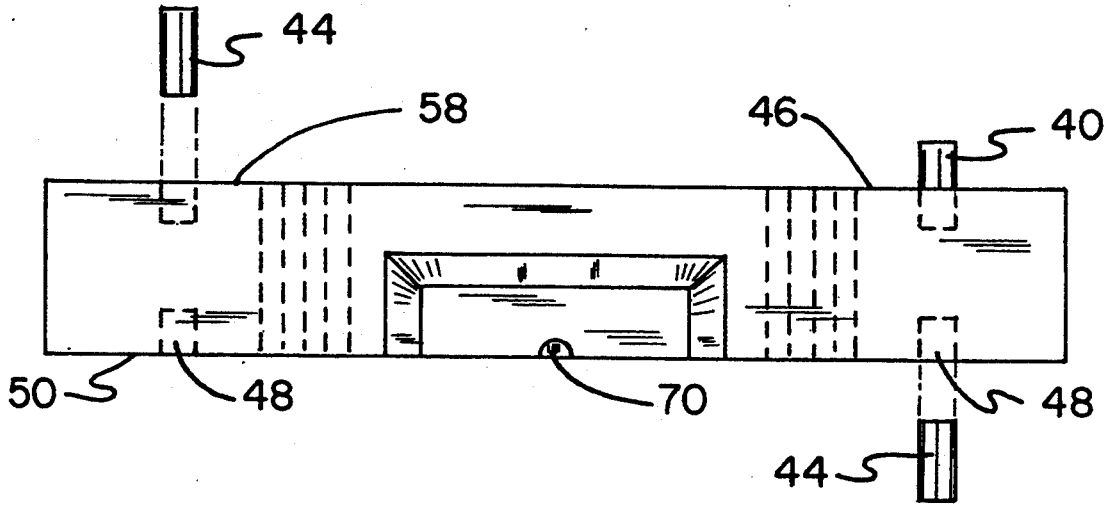
FIG. 7 is a top elevational view of the component shown in FIG. 6 taken along line 7—7 of FIG. 6.
Figure 8:
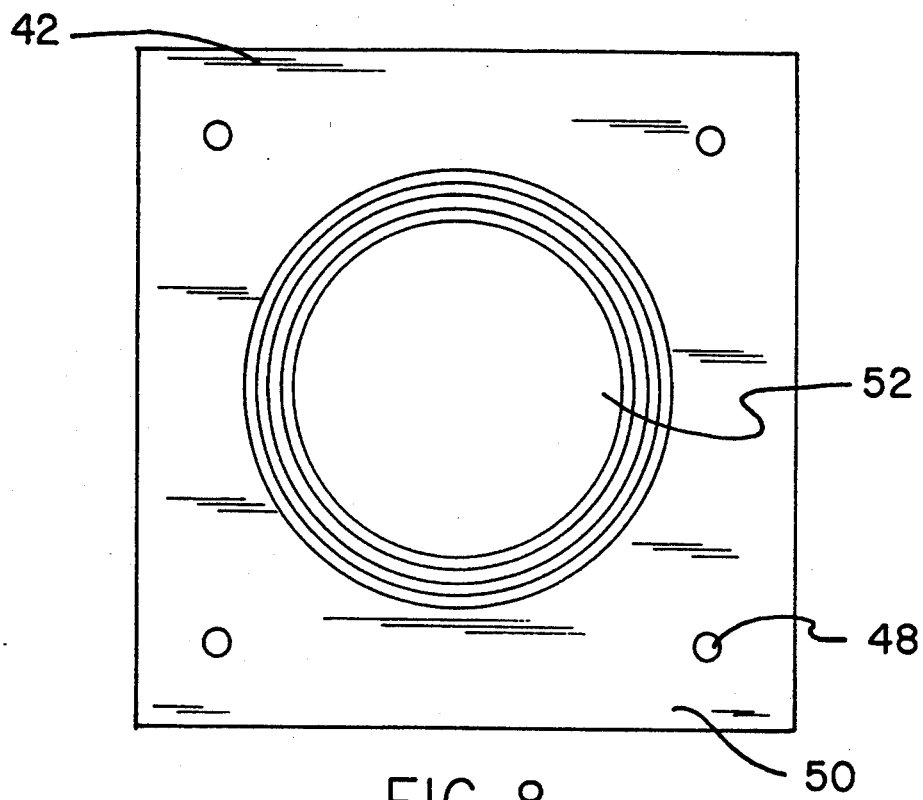
FIG. 8 is a front elevational view of another of the components shown in FIG. 2.
Figure 9:
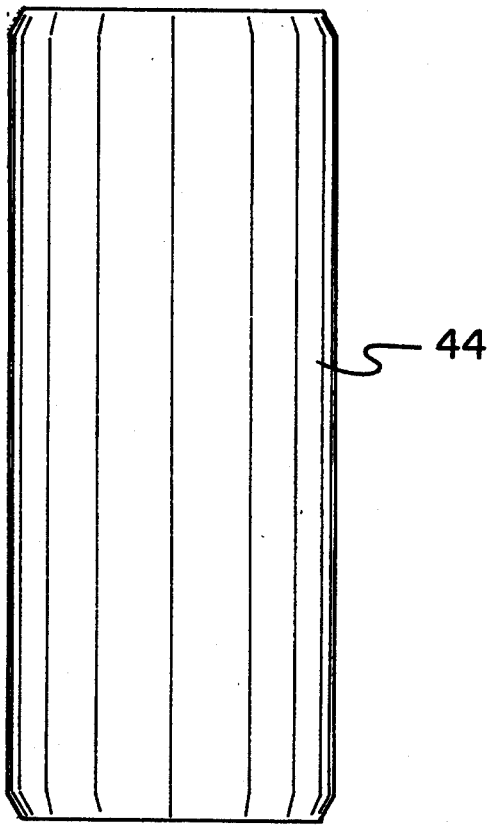
FIG. 9 is a perspective view of an alignment pin.

With reference now to the drawings, and in particular to FIG. 1 thereof, the preferred embodiment of the new and improved variable weight mold embodying the principles and concepts of the present invention and generally designated by the reference numeral 10 will be described.

The present invention, the new and improved variable weight mold, is comprised of a plurality of component elements. Such component elements in their broadest context, include a first end molding component, a second end molding component, a plurality of intermediate molding components, a pair of filler molding components, coupling elements for the second end component and additional coupling elements for the end components. Such components are individually configured and correlated with respect to each other so as to attain the desired objectives.

More specifically, the system 10 of the present invention has at one end a first end molding component 12. Such component has an imperforate exterior face 14. It also has an interior face 15 formed with alignment pins 16. The interior face also has a recess 17 in the shape of a hemisphere for the receipt of the fluid material to be molded. In addition, the exterior face has a plurality of lateral clamping members 18. Such clamping members are formed with apertures for securing coupling elements as will be later described.

At the opposite end of the mold is a second end molding component 22. Such component has an exterior face 24 with a horizontal bore 26 extending centrally therethrough. Such bore is adapted to be filled with an elastomeric filler material 27 to preclude inadvertent removal of the molding material during introduction while in a liquid state. In addition, such component has an interior face 28 with alignment holes 30. A recess 31 in the shape of a partial sphere is formed for the receipt of fluid material to be molded. The second end component is provided with lateral clamping members 32. Such clamping members are alignable with the clamping members 18 of the first molding component for the receipt of coupling elements as will be later described. The second end molding component is formed of a pair of laterally disposed subcomponents 34, 36. The subcomponents have vertical clamping members 38 secured to each subcomponent for the joining thereof.

Next provided are a plurality of intermediate molding components 42. Such intermediate components are each formed with alignment pins 44 positionable on one face 46 and alignment holes 48 in the opposite face 50. In addition, a recess 52 is formed therethrough and adapted to be positioned between the first end molding component and the second end component. The number of intermediate components is a function of the desired size of the molded end products.

The last component with a recess for the receipt of the molding material is a pair of filler molding components 58, 60. Both are formed with alignment pins 44 on one face and alignment holes 48 in the opposite face. The alignment holes and ends of the various components are in axial alignment for insuring the proper coupling of one component to another as shown in FIG. 1. This insures that the recesses of the various components are correlated to create the spherical shape desired for the final end product.

Each filler molding component is provided with a recess therethrough. The filler molding components are adapted to be positioned between the end components 42 and adjacent to the intermediate components. The filler components further include a vertical bore 70 which is formed when the two filler molding components are secured together. In addition, a well is formed thereabove so that the fluid molding material may be poured into the cavity formed by the recesses during operation and use. The well acts to receive and hold excess liquid molding material.

The various components of the system 10 are secured together through coupling elements 74. Such coupling elements are for coupling together the clamping members of the two subcomponents of the second end component. Such coupling elements include a bolt having a first end with a pin 76 extending through an aperture 77 which is formed through one clamping member and bolt end. The opposite bolt end is formed of threads 78 and a wing nut 80 and bearing contact with the adjacent clamping member.

Additional coupling elements are provided for coupling together the clamping members of the first end component and the second end component. Such additional coupling elements include bolts 38 with an associated pin 84 positioned in an aperture which extends through the clamping members of the first end component. The second end of the bolt is formed of threads 90 with an associated wing nut 92 in bearing contact with the clamping members of the second end component. The various coupling elements are correlated to hold together the various components of the system 10 during operation and use.

The present invention can be stacked with other such units to produce castings of various sizes and weights for making sinker weights for anglers, but the same concept may be applied to other products.

The molds are made of aluminum to reduce the weight and to avoid corrosion. Since the sinkers are made of lead alloys, whose melting temperature is much lower than that of the aluminum, that material is an excellent choice for the task. The molds can be made in any shape and size, but for this application, a relatively thin rectangular configuration is suitable. A cavity of the shape of the sinker is provided in the mold, together with a filling sprue. Several such molds are made, each having registration holes for pins to align the cavities when they are stacked together.

For small sinkers, only one mold may be needed. Heavy sinkers will require several molds. Blank plates are added on each end to contain the metal when it is poured into the multi-layer mold. After the metal solidifies and cools, the sinkers are removed from the molds, the sprue is removed, and the edges are trimmed.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by LETTERS PATENT of the United States is as follows:

1. A new and improved variable weight mold comprising, in combination:

a first end molding component having an imperforate exterior face and an interior face with alignment pins and a recess for the receipt of fluid material to be molded, the exterior face having a plurality of lateral clamping members with apertures;

a second end molding component having an exterior face with a horizontal bore and an interior face with alignment holes and a recess for the receipt of fluid material to be molded, the second end component being provided with lateral clamping members, the second component being formed of a pair of laterally disposed subcomponents with vertical clamping members secured to each subcomponent;

a plurality of intermediate molding components, each with alignment pins on one face and alignment holes in the opposite face and with a recess therethrough adapted to be positioned between the end components, the number of intermediate components being a function of the desired size of the molded end products;

a pair of filler molding components both with alignment pins on one face and alignment holes in the opposite face and with a recess therethrough adapted to be positioned between the end components, the filler components including a vertical bore and well thereabove;

coupling elements for coupling together the clamping members of the two subcomponents of the second end component; and additional coupling elements for coupling together the clamping members of the first end component with the second end component.

2. A variable weight mold comprising:

a first end molding component having an imperforate exterior face and an interior face with alignment pins and a recess for the receipt of fluid material to be molded;

a second end molding component having an exterior face with a horizontal bore and an interior face with alignment holes and a recess for the receipt of fluid material to be molded, the second end component being provided with lateral clamping members, the second component being formed of a pair of laterally disposed subcomponents;

a plurality of intermediate molding components, each with alignment pins on one face and alignment holes in the opposite face and with a recess therethrough adapted to be positioned between the end components, the number of intermediate components being a function of the desired size of the molded end products; and a pair of filler molding components both with alignment pins on one face and alignment holes in the opposite face and with a recess therethrough adapted to be positioned between the end components, the filler components including a vertical bore and well thereabove.

3. The mold as set forth in claim 2 and further including coupling elements for coupling together the two subcomponents of the second end component.

4. The mold as set forth in claim 3 and further including additional coupling elements for coupling together the first end component with the second end component.

5. The apparatus as set forth in claim 2 wherein the components are fabricated of aluminum.

* * * * *